US009689547B2

(12) United States Patent
Matsumoto et al.

(10) Patent No.: US 9,689,547 B2
(45) Date of Patent: Jun. 27, 2017

(54) VEHICLE LAMP UNIT INCLUDING LENS REGIONS HAVING DIFFERENT LIGHT SCATTERING PROPERTIES

(71) Applicant: KOITO MANUFACTURING CO., LTD., Minato-ku, Tokyo (JP)

(72) Inventors: Akinori Matsumoto, Shizuoka (JP); Shingo Kato, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 75 days.

(21) Appl. No.: 14/628,488

(22) Filed: Feb. 23, 2015

(65) Prior Publication Data

US 2015/0241008 A1 Aug. 27, 2015

(30) Foreign Application Priority Data

Feb. 24, 2014 (JP) ..... 2014-033057
Jan. 15, 2015 (JP) ..... 2015-005967

(51) Int. Cl.
*F21S 8/10* (2006.01)

(52) U.S. Cl.
CPC ..... *F21S 48/125* (2013.01); *F21S 48/1159* (2013.01); *F21S 48/1258* (2013.01);
(Continued)

(58) Field of Classification Search
CPC .... F21S 48/125; F21S 48/1283; F21S 48/145; F21S 48/1388; F21V 5/00; F21V 5/002
See application file for complete search history.

(56) References Cited

U.S. PATENT DOCUMENTS 1,339,604 A * 5/1920 Morrison ..... F21S 48/1233 362/339
1,363,805 A * 12/1920 Morrison ..... F21S 48/1233 362/339

(Continued)

FOREIGN PATENT DOCUMENTS

CN 101144579 A 3/2008
CN 103574458 A 2/2014

(Continued)

OTHER PUBLICATIONS

Communication dated Dec. 5, 2016, from the State Intellectual Property Office of People's Republic of China in counterpart Application No. 201510084009.X.

(Continued)

*Primary Examiner* — Robert May
(74) *Attorney, Agent, or Firm* — Sughrue Mion, PLLC

(57) ABSTRACT

A projection lens is disposed so that light emitted from a light source passes the projection lens. A shade is disposed in rear of the projection lens so as to block a part of the light emitted from the light source. The projection lens includes a first region and a second region. The first region has a first light scattering property. The second region has a second light scattering property lower than the first light scattering property. The shade and the projection lens are disposed so that a part of light projecting an edge of the shade as a peripheral edge of a light distribution pattern passes through the first region and another part of the light projecting the edge of the shade passes through the second region.

9 Claims, 4 Drawing Sheets

(52) U.S. Cl.
CPC ..... *F21S 48/1283* (2013.01); *F21S 48/13* (2013.01); *F21S 48/1323* (2013.01); *F21S 48/1388* (2013.01); *F21S 48/145* (2013.01)

(56) References Cited

U.S. PATENT DOCUMENTS

| | | | | |
|---|---|---|---|---|
| 4,796,171 | A * | 1/1989 | Lindae | F21S 48/1258 362/308 |
| 5,036,438 | A * | 7/1991 | Nakata | F21S 48/10 362/308 |
| 7,631,998 | B2 * | 12/2009 | Koike | F21S 48/1159 362/267 |
| 7,654,713 | B2 * | 2/2010 | Tendo | F21S 48/1283 362/309 |
| 7,722,232 | B2 * | 5/2010 | Nakada | F21S 48/1159 362/507 |
| 7,736,036 | B2 | 6/2010 | Tatsukawa | |
| 2005/0254254 | A1 | 11/2005 | Moseler et al. | |
| 2008/0062709 | A1 | 3/2008 | Mochizuki et al. | |
| 2011/0011133 | A1 | 1/2011 | Moseler et al. | |

FOREIGN PATENT DOCUMENTS

| | | | |
|---|---|---|---|
| JP | 2002-050217 | A | 2/2002 |
| JP | 2007-265864 | A | 10/2007 |
| JP | 2012-59551 | A | 3/2012 |
| JP | 2013-101865 | A | 5/2013 |
| JP | 2013-239408 | A | 11/2013 |
| KR | 10-2006-0046628 | A | 5/2006 |

OTHER PUBLICATIONS

Communication dated Nov. 14, 2016, issued by the Korean Intellectual Property Office in counterpart Korean application No. 10-2015-0023095.

* cited by examiner

VEHICLE LAMP UNIT INCLUDING LENS REGIONS HAVING DIFFERENT LIGHT SCATTERING PROPERTIES

CROSS REFERENCE TO RELATED APPLICATION(S)

This application is based on and claims priority under 35 U.S.C. §119 to Japanese Patent Application Nos. 2014-033057 (filed on Feb. 24, 2014) and 2015-005967 (filed on Jan. 15, 2015), the entire contents of which are incorporated herein by reference.

BACKGROUND

Technical Field

Exemplary embodiments of the invention relate to a lamp unit to be mounted on a vehicle.

Related Art

A unit having a light source, a projection lens and a shade has been known as such a lamp unit. The projection lens is disposed so that at least a part of light emitted from the light source passes through the projection lens. The shade is disposed in rear of the projection lens so as to block a part of the light emitted from the light source. The light passing through the projection lens forms a light distribution pattern that illuminates an area ahead of the lamp unit. On this occasion, an edge of the shade is projected ahead of the projection lens as a peripheral edge of the light distribution pattern. A low beam pattern that illuminates an area ahead of the vehicle by a short distance so as to cause no glare to vehicles running ahead is exemplified as one example of the light distribution pattern. A cutoff line that forms an upper edge of the low beam pattern is exemplified as one example of the peripheral edge of the light distribution pattern.

There is a demand to blur the cutoff line in order to improve forward visibility and suppress a sense of discomfort felt by a driver. To meet this demand, there has been known a configuration in which a light scattering surface is formed on a surface of a projection lens so that light projecting an edge of a shade passes through the light scattering surface (for example, see JP 2007-265864 A (corresponding to U.S. Pat. No. 7,736,036 B2)).

SUMMARY

For lamp units of this type, aiming work for adjusting a reference position of an optical axis of the projection lens in up, down, left and right directions is performed, for example, before shipment. On that occasion, the cutoff line may be used as a reference for the adjustment work. However, if the cutoff line is blurred as described above, it is difficult to use the cutoff line as a reference for the adjustment work. Thus, the efficiency of the work may deteriorate.

One exemplary embodiment of the invention improves the efficiency of the aiming work while ensuring forward visibility and suppressing a sense of discomfort felt by a driver.

(1) According to one exemplary embodiment, a lamp unit to be mounted on a vehicle includes a light source, a projection lens, and a shade. The projection lens is disposed so that light emitted from the light source passes through the projection lens. The shade is disposed in rear of the projection lens so as to block a part of the light emitted from the light source. The projection lens includes a first region and a second region. The first region has a first light scattering property. The second region has a second light scattering property lower than the first light scattering property. The shade and the projection lens are disposed so that (i) a part of light projecting an edge of the shade as a peripheral edge of a light distribution pattern passes through the first region and (ii) another part of the light projecting the edge of the shade passes through the second region.

The light passing through the first region is subjected to relatively strong scattering. As a result, the edge of the shade is projected as a blurred peripheral edge in the light distribution pattern which is formed ahead of the lamp unit. It is, therefore, possible to meet the demand to improve forward visibility and suppress a sense of discomfort felt by a driver.

On the other hand, the light passing through the second region is not subjected to scattering (or a degree of scattering is relatively small). Therefore, the edge of the shade is projected as a clear peripheral edge in the light distribution pattern, which is formed ahead of the lamp unit. That is, the clear peripheral edge can be seen together with the blurred peripheral edge formed by the light passing through the first region.

Thus, when aiming work is performed for the lamp unit, the clear peripheral edge can be used as a reference for adjustment. It is, therefore, possible to improve the efficiency of the aiming work while ensuring forward visibility and suppressing a sense of discomfort felt by the driver.

(2) In the lamp unit of (1), the shade and the projection lens may be disposed so that light forming a part, which does not include the peripheral edge, of an illumination area of the light distribution pattern passes through the second region.

With this configuration, the part, which does not include the peripheral edge, of the illumination area of the light distribution pattern formed ahead of the lamp unit is formed by light which is not subjected to scattering (or a degree of scattering is small). Such light is so low in the degree of interference that a part with uneven illuminance can be suppressed from being formed in the illumination area. It is, therefore, possible to further suppress a sense of discomfort felt by the driver while ensuring forward visibility and improving the efficiency of the aiming work.

(3) The lamp unit of any one of (1) to (2) may further include a reflector that reflects and causes a part of the light emitted from the light source to pass through the second region of the projection lens as light that illuminates an overhead sign.

With this configuration, the light for illuminating the overhead sign which goes upwards after passing through the projection lens is not subjected to scattering (or a degree of scattering is small). It is, therefore, possible to suppress the light for illuminating the overhead sign from going towards a vehicle running ahead due to scattering. Accordingly, it is possible not only to improve the efficiency of the aiming work while ensuring forward visibility and suppressing a sense of discomfort felt by the driver, but also to suppress glare caused to an occupant(s) of a vehicle running ahead.

(4) In the lamp unit of any one of (1) to (3), the projection lens may be a resin molded article.

With this configuration, a minute irregular surface for obtaining the first light scattering property can be formed in the first region at a low cost and accurately. Also, the surface states of the first region and the second region can be distinguished at a low cost and accurately. Thus, the blurred peripheral edge and the clear peripheral edge can be formed accurately in desired positions. A lamp unit capable of improving the efficiency of the aiming work while ensuring forward visibility and suppressing a sense of discomfort felt by the driver can be, therefore, provided at a low cost.

(5) The lamp unit of any one of (1) to (4) may further include a holder. The holder holds a peripheral edge portion of the projection lens. The peripheral edge portion of the projection lens is welded to the holder. Protrusions for welding positioning are formed in the peripheral edge portion of the projection lens.

With this configuration, the first region and the second region for obtaining desired light scattering properties can be positioned accurately with respect to the holder. As a result, the blurred peripheral edge and the clear peripheral edge can be formed accurately in desired positions. It is, therefore, possible to improve the efficiency of the aiming work while ensuring forward visibility and suppressing a sense of discomfort felt by the driver.

DETAILED DESCRIPTION

Exemplary embodiments will be described below in detail with reference to the accompanying drawings. In each drawing that will be referred to in the following description, the scale will be changed appropriately to show each member in recognizable dimensions.

Figure 1:
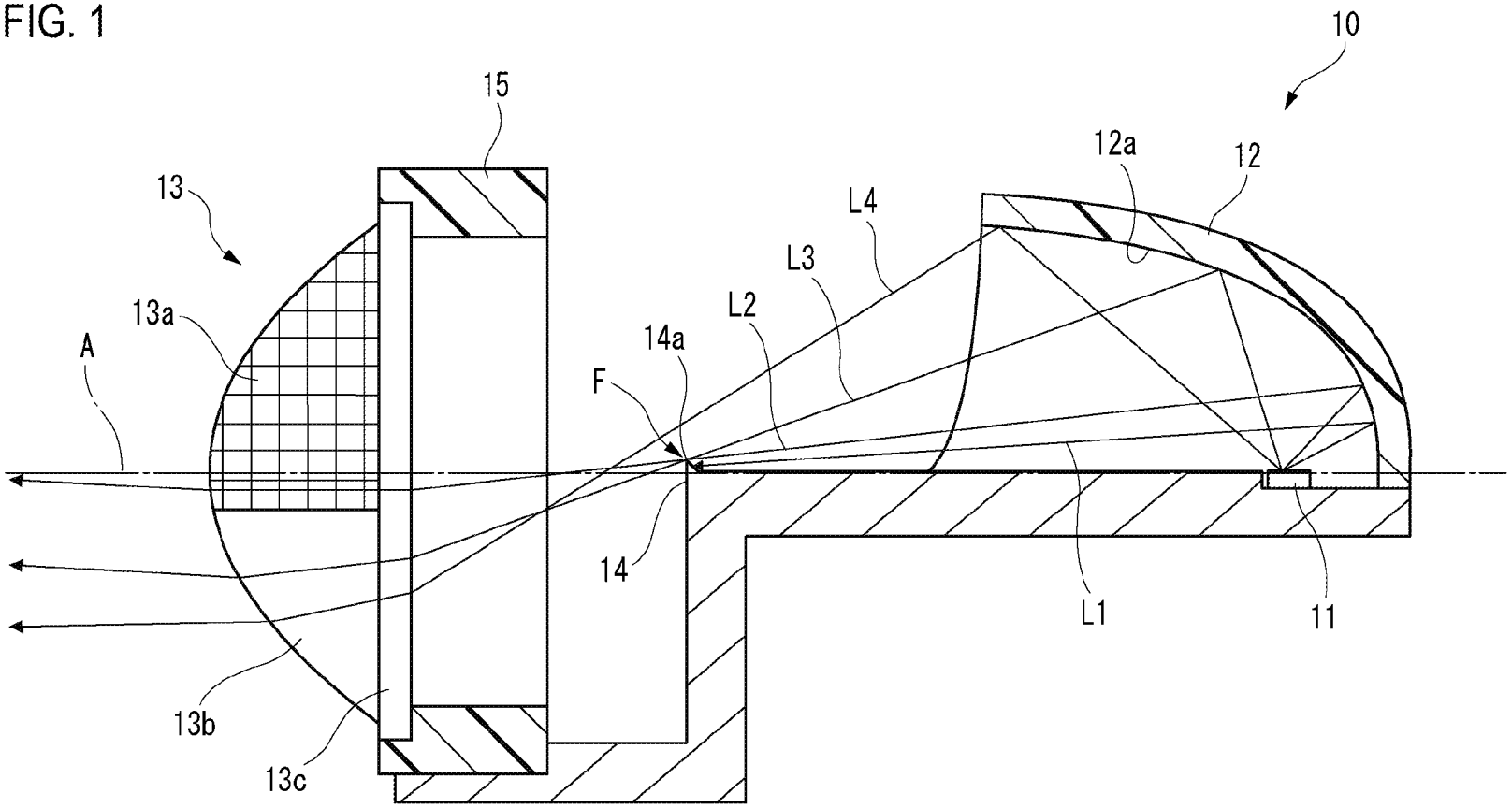
FIG. 1 is a view partially sectionally showing a lamp unit according to a first exemplary embodiment of the invention.

FIG. 1 is a side view in which a lamp unit 10 according to a first exemplary embodiment is viewed from left, and a part of the lamp unit 10 is shown sectionally. The lamp unit 10 is, for example, mounted on a front portion of a vehicle, and used for illuminating an area ahead of the vehicle.

The lamp unit 10 is provided with a light source 11. In this exemplary embodiment, the light source 11 is a semiconductor light emitting element. Examples of the semiconductor light emitting element include a light emitting diode (LED), a laser diode, an organic EL element, etc.

The lamp unit 10 is provided with a reflector 12. The reflector 12 has a reflection surface 12*a*. The reflection surface 12*a* has a shape based on an elliptic sphere whose major axis coincides with an optical axis A extending in a front and rear direction of the lamp unit 10. The light source 11 is disposed at a first focal point of an ellipse making up a vertical section of the reflection surface 12*a*. With this configuration, the light emitted from the light source 11 is focused at a second focal point of the ellipse.

The lamp unit 10 is provided with a projection lens 13. The projection lens 13 is disposed so that a rear focal point F of the projection lens 13 coincides with the second focal point of the reflection surface 12*a* of the reflector 12. The projection lens 13 is disposed so that at least a part of the light emitted from the light source 11 passes through the projection lens 13. As a result, an image at the rear focal point F is projected ahead of the lamp unit 10 as an inverted image.

The lamp unit 10 is provided with a shade 14. The shade 14 is disposed in rear of the projection lens 13. More specifically, the shade 14 is disposed near the rear focal point F of the projection lens 13. The shade 14 is disposed to block a part of the light emitted from the light source 11. In the example shown in FIG. 1, light L1 emitted from the light source 11 is blocked by the shade 14.

Figure 2A:
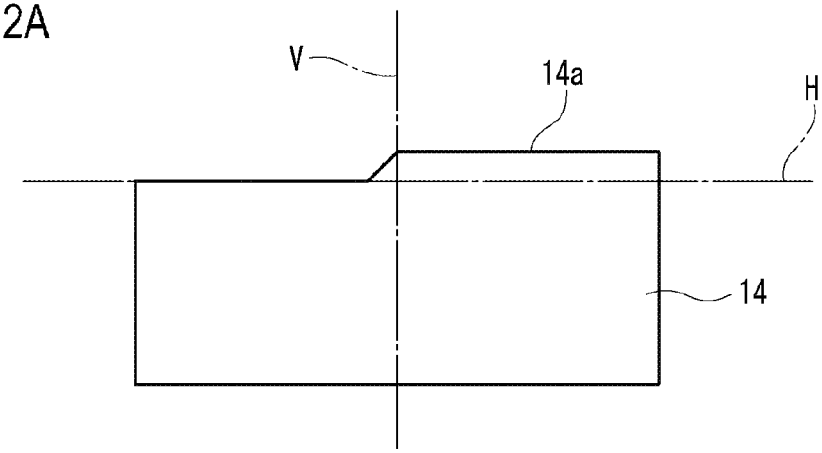
FIGS. 2A to 2C are views for explaining a light distribution pattern formed by the lamp unit.
Figure 2B:
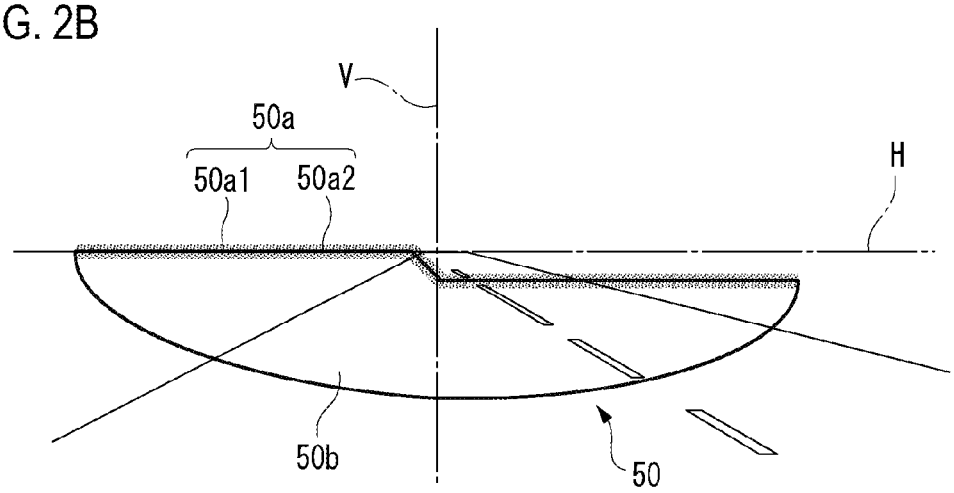

FIG. 2A is a front view showing the shape of the shade 14 viewed from the front of the lamp unit 10. FIG. 2B schematically shows a low beam pattern 50 (an example of a light distribution pattern) formed by the lamp unit 10. In FIGS. 2A and 2B, a virtual line V indicates a vertical reference line, and a virtual line H indicates a horizontal reference line. The low beam pattern 50 is a light distribution pattern with which an area ahead of the vehicle by a short distance is illuminated so as to cause no glare to vehicles running ahead.

The low beam pattern 50 includes a cutoff line 50*a* (an example of a peripheral edge of the light distribution pattern) at an upper edge thereof. The cutoff line 50*a* is formed by projecting the shape of an upper edge 14*a* of the shade 14 ahead of the projection lens 13 by the light emitted from the light source 11. An area above the cutoff line 50*a* is a non-illumination area formed by blocking the light emitted from the light source 11 by the shade 14. An area blow the cutoff line 50*a* is an illumination area 50*b* formed by the light which is emitted from the light source 11 and which is not blocked by the shade 14.

Figure 2C:
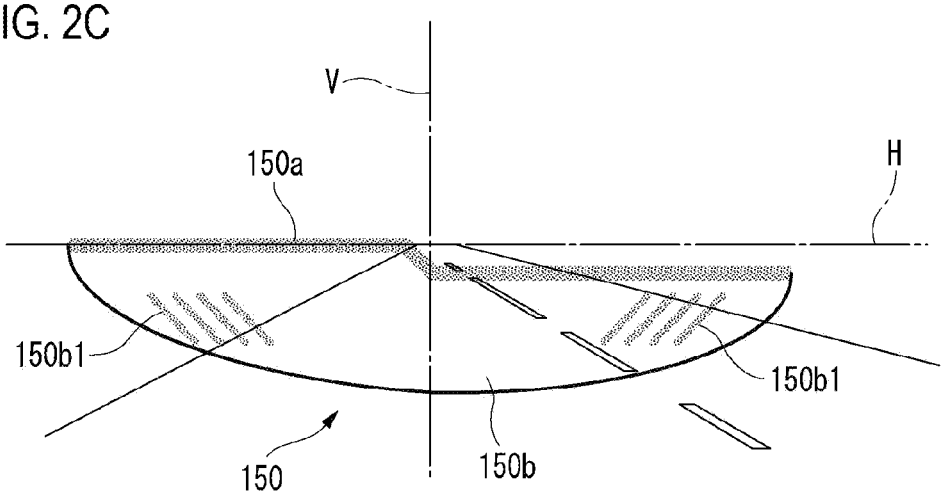
Figure 3:
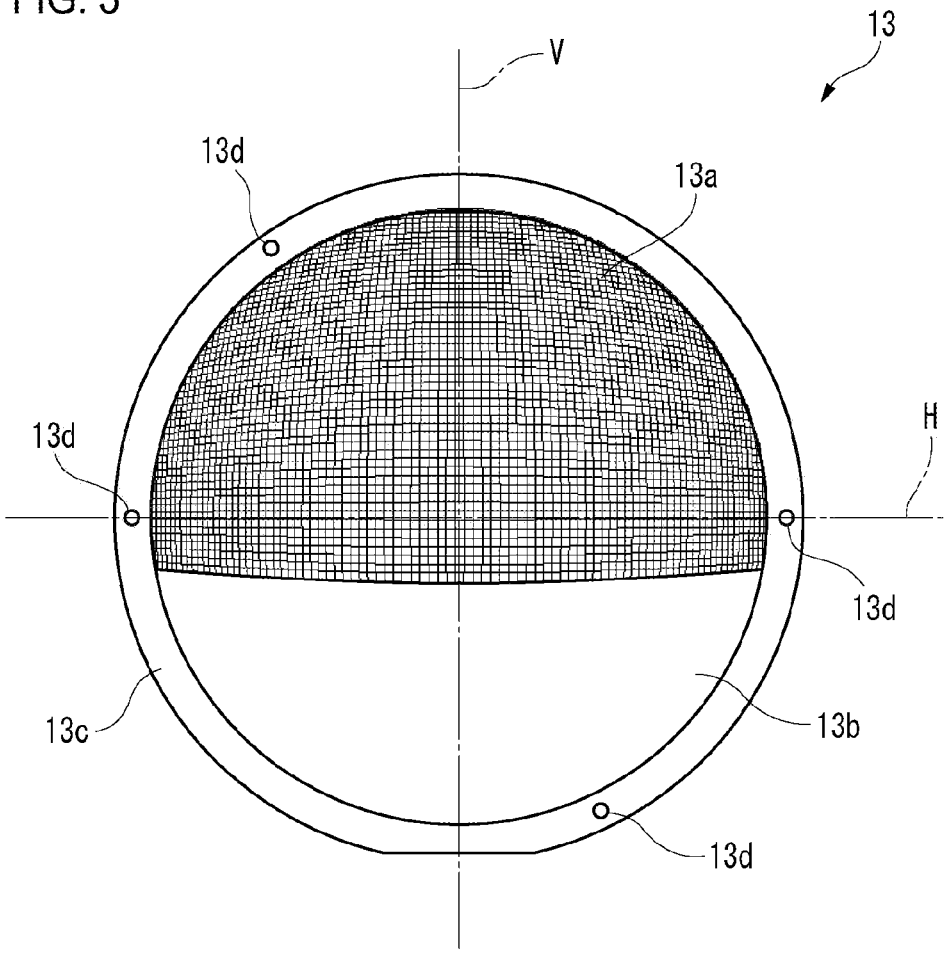
FIG. 3 is a front view showing the external appearance of a projection lens provided in the lamp unit.

FIG. 3 is a front view showing the external appearance of the projection lens 13. Virtual lines V and H in FIG. 3 correspond to the virtual lines V and H in FIG. 2. The projection lens 13 has a first region 13*a* and a second region 13*b*. The first region 13*a* has a first light scattering property which is provided by minute irregularities formed in a surface thereof. The minute irregularities are formed by protrusions (dimples), grooves, surface texturing, etc. The second region 13*b* is made into a smooth surface. As a result, the second region 13*b* has a second light scattering property which is lower than the first light scattering property.

As shown in FIG. 1, the projection lens 13 and the shade 14 are disposed so that (i) a part L2 of light, which projects the upper edge 14*a* of the shade 14 as the cutoff line 50*a*, passes through the first region 13*a* and (ii) another part L3 of the light passes through the second region 13*b*.

The minute irregular surface formed in the first region 13*a* scatters the light L2. As a result, the upper edge 14*a* of the shade 14 is projected as a blurred cutoff line 50*a*1 (thick grey line) in the low beam pattern 50 shown in FIG. 2B. It is, therefore, possible to meet the demand to improve forward visibility and suppress a sense of discomfort felt by the driver.

On the other hand, the light L3 passing through the second region 13*b* is not subjected to scattering (or a degree of scattering is small). As a result, the upper edge 14*a* of the shade 14 is projected as a clear cutoff line 50*a*2 (thin solid line) in the low beam pattern 50 shown in FIG. 2B. That is, the blurred cutoff line 50*a*1 formed by the light L2 passing through the first region 13*a* and the clear cutoff line 50*a*2 formed by the light L3 passing through the second region 13*b* can be seen together.

Thereby, when aiming work is performed for the lamp unit 10, the clear cutoff line 50*a*2 can be used as a reference for adjustment. It is, therefore, possible to improve the efficiency of the aiming work while ensuring forward visibility and suppressing a sense of discomfort felt by the driver.

A low beam pattern 150 according to a comparative example shown in FIG. 2C shows a case where an illumination area 150*b* including a cutoff line 150*a* is formed only by light which is subjected to scattering. The shape of the edge of the shade is projected as the cutoff line 150*a* which is blurred. Also, light which are subjected to scattering interfere with each other so as to form uneven illuminance

150*b*1 in the illumination area 150*b*. Such uneven illuminance causes a driver to feel a sense of discomfort.

In this exemplary embodiment, as shown in FIG. 1, the projection lens 13 and the shade 14 are disposed so that light L4 forming a part, which does not include the cutoff line 50*a*, of the illumination area 50*b* of the low beam pattern 50 passes through the second region 13*b*. That is, of the light from the light source 11 which is not blocked by the shade 14, the light L4 which does not contribute to the projection of the upper edge 14*a* of the shade 14 passes through the second region 13*b*.

With this configuration, the illumination area 50*b* of the low beam pattern 50 shown in FIG. 2B is formed by light which is not subjected to scattering (or a degree of scattering is small). Such light is so low in the degree of interference that uneven illuminance can be suppressed from being formed in the illumination area Sob. It is, therefore, possible to further suppress a sense of discomfort felt by the driver while ensuring forward visibility and improving the efficiency of the aiming work.

A material of the projection lens 13 is not particularly limited. In this exemplary embodiment, the projection lens 13 which is a resin molded article is used.

In this case, the minute irregular surface for obtaining a desired light scattering property can be formed in the first region 13*a* at a low cost and accurately. Also, the surface states of the first region 13*a* and the second region 13*b* can be distinguished at a low cost and accurately. As a result, the blurred cutoff line 50*a*1 and the clear cutoff line 50*a*2 can be formed accurately in desired positions. Thus, a lamp unit capable of improving the efficiency of the aiming work while ensuring forward visibility and suppressing a sense of discomfort felt by the driver can be provided at a low cost.

As shown in FIG. 1, the lamp unit 10 is provided with a lens holder 15. The lens holder 15 holds a peripheral edge portion 13*c* of the projection lens 13. The peripheral edge portion 13*c* is welded to the lens holder 15. As shown in FIG. 3, a plurality of protrusions 13*d* for welding positioning are formed in the peripheral edge portion 13*c*.

With this configuration, the first region 13*a* and the second region 13*b* for obtaining desired light scattering properties can be positioned accurately with respect to the lens holder 15. As a result, the blurred cutoff line 50*a*1 and the clear cutoff line 50*a*2 can be formed accurately in desired positions. It is therefore possible to improve the efficiency of the aiming work while ensuring forward visibility and suppressing a sense of discomfort felt by the driver.

Figure 4:
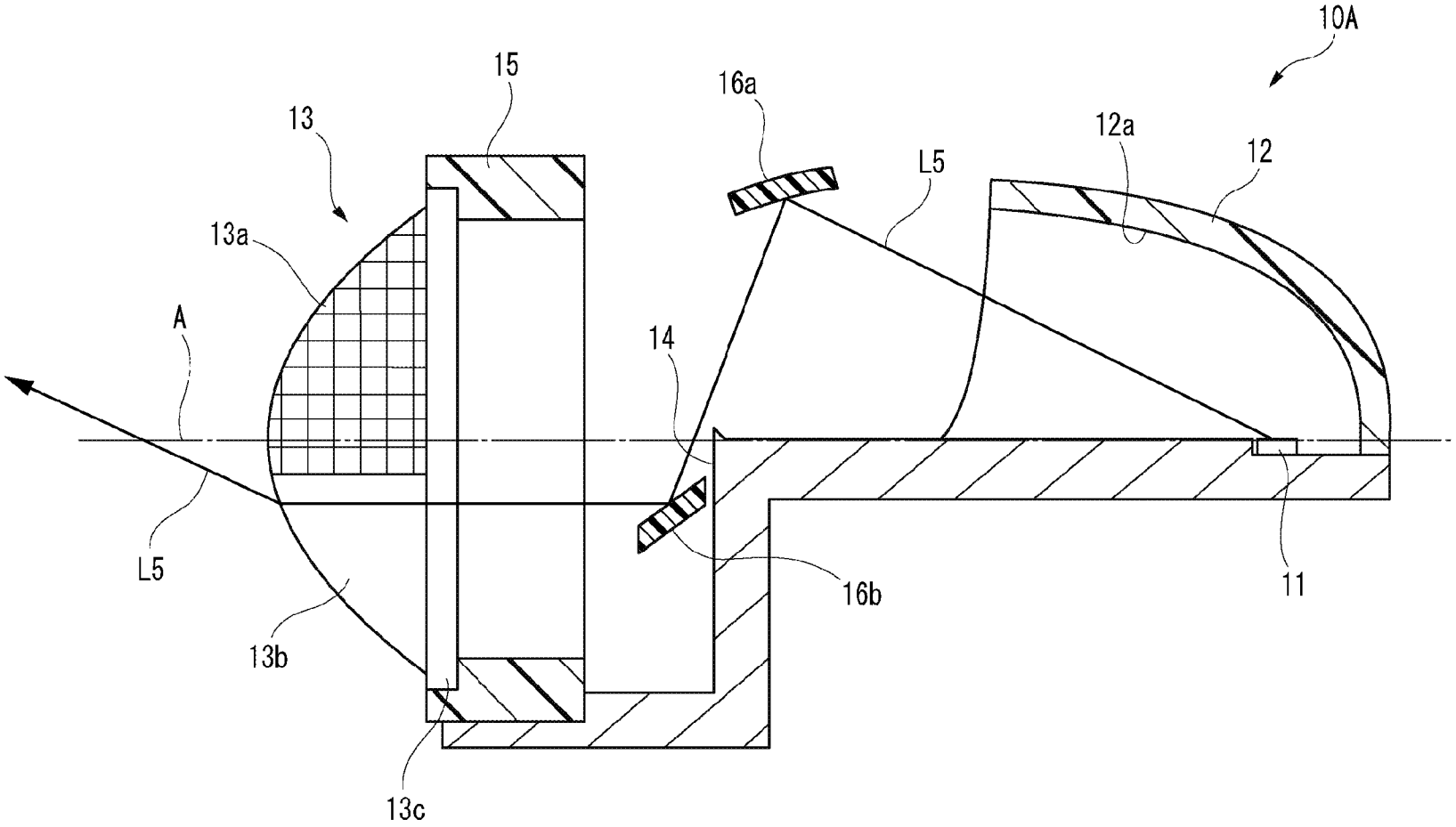
FIG. 4 is a view partially sectionally showing a lamp unit according to a second exemplary embodiment of the invention.

FIG. 4 is a side view of a lamp unit 10A according to a second exemplary embodiment when viewed from a left side thereof. Elements having the same or similar structure and/or function as or to those of the lamp unit 10 according to the first exemplary embodiment will be given the same reference numerals, and redundant description thereon will be omitted. Also, the light rays L1 to L4 shown in FIG. 1 will not be shown.

The lamp unit 10A is provided with additional reflectors 16*a*, 16*b* (a support structure for the additional reflectors 16*a*, 16*b* is not shown). The additional reflectors 16*a*, 16*b* are configured to reflect light L5 emitted from the light source 11 so as to form light that illuminates an overhead sign. The "overhead sign" means a road sign that is located above and ahead of a vehicle and that passes over a head of a driver as the vehicle runs, and the like. The additional reflectors 16*a*, 16*b* are disposed so that the light for illuminating the overhead sign passes through the projection lens 13 with avoiding the first region 13*a*. In other words, the additional reflectors 16*a*, 16*b* are disposed so that the light for illuminating the overhead sign passes through the second region 13*b* of the projection lens 13.

With this configuration, the light L5 for illuminating the overhead sign which goes upwards after passing through the projection lens 13 is not subjected to scattering (or a degree of scattering is small). It is, therefore, possible to suppress the light L5 for illuminating the overhead sign from going towards a vehicle running ahead due to scattering. Accordingly, it is possible not only to improve the efficiency of the aiming work while ensuring forward visibility and suppressing a sense of discomfort felt by the driver, but also to suppress glare caused to an occupant(s) of a vehicle running ahead.

The aforementioned exemplary embodiments are intended to facilitate understanding of the invention, but do not limit the invention. It is obvious that the invention may be changed or modified without departing the significance thereof, and any equivalent to the invention is included in the invention.

In the aforementioned exemplary embodiments, the semiconductor light emitting element is used as the light source 11. However, a lamp light source such as an incandescent lamp, a halogen lamp, a discharge lamp or a neon lamp may be used.

In the aforementioned exemplary embodiments, the reflector 12 has the reflection surface 12*a* whose shape is based on the elliptic sphere. However, the shape of the reflection surface 12*a* may have any shape so long as the light L2 and the light L3 which are emitted from the light source 11 and which project the upper edge 14*a* of the shade 14 as the cutoff line 50*a* of the low beam pattern 50 pass through the first region 13*a* and the second region 13*b* of the projection lens 13, respectively. Alternatively, the reflector 12 may be removed.

In the aforementioned exemplary embodiments, the upper edge 14*a* of the shade 14 is projected as the peripheral edge of the light distribution pattern which is formed ahead of the lamp unit 10. However, the shape of the shade 14 the position of the edge to be projected may be set desirably so long as a desired peripheral edge shape can be projected.

In the second exemplary embodiment, the additional reflectors 16*a*, 16*b* are exemplified as independent optical parts. However, the additional reflector 16*a* and the shade 14 may make up a single piece part. Alternatively, the additional reflector 16*b* and the shade 14 may make up a single piece part. Also, one of the additional reflectors 16*a*, 16*b* may be omitted so long as the light L5 for illuminating the overhead sign passes through the projection lens 13 with avoiding the first region 13*a*.

In the aforementioned exemplary embodiments, the first region 13*a* of the projection lens 13 is formed of the minute irregular surface, and the second region 13*b* is formed of the smooth surface. However, an irregular structure may be formed in the second region 13*b* so long as the second light scattering property of the second region 13*b* is lower than the first light scattering property of the first region 13*a*.

DESCRIPTION OF REFERENCE NUMERALS

10: lamp unit
11: light source
13: projection lens
13*a*: first region
13*b*: second region
13*c*: peripheral edge portion
13*d*: protrusion
14: shade

14*a*: upper edge of shade
16*a*, 16*b*: additional reflectors
50: low beam pattern
50*a*: cutoff line
L1: light blocked by shade
L2, L3: light projecting upper edge of shade
L4: light not blocked by shade

What is claimed is:

1. A lamp unit to be mounted on a vehicle, the lamp unit comprising:

a light source;

a projection lens that is disposed so that light emitted from the light source passes through the projection lens; and a shade that is disposed in rear of the projection lens so as to block a part of the light emitted from the light source, wherein an optical axis of the lamp unit extends in a front and rear direction of the lamp unit, the shade comprises an upper edge disposed along the optical axis, the projection lens includes a first region that has minute irregularities formed in a surface thereof to provide a first light scattering property, and a second region that has a surface with roughness smoother than that of the first region to provide a second light scattering property lower than the first light scattering property, the shade and the projection lens are disposed so that (i) a part of light projecting an edge of the shade as a peripheral edge of a light distribution pattern passes through the first region and (ii) another part of the light projecting the edge of the shade passes through the second region and the second region is completely disposed in a lower half portion of the projection lens with respect to a front view of the lamp unit, the second region being disposed below the upper edge of the shade in an upper and lower direction with respect to the front view of the lamp unit, the upper and lower direction being perpendicular to the optical axis.

2. The lamp unit according to claim 1, wherein the shade and the projection lens are disposed so that light forming a part, which does not include the peripheral edge, of an illumination area of the light distribution pattern passes through the second region.

3. The lamp unit according to claim 1, further comprising:

a reflector that reflects and causes a part of the light emitted from the light source to pass through the second region of the projection lens, wherein the second region of the projection lens causes said part of the light reflected by the reflector to project upward, relative to an optical axis extending in a front and rear direction of the lamp unit, after passing therethrough.

4. The lamp unit according to claim 1, wherein the projection lens is a resin molded article.

5. The lamp unit according to claim 1, further comprising:

a holder that holds a peripheral edge portion of the projection lens, wherein the peripheral edge portion of the projection lens is welded to the holder, and protrusions for welding positioning are formed in the peripheral edge portion of the projection lens.

6. The lamp unit according to claim 1, wherein said minute irregularities comprise at least one of protrusions, grooves, and surface texturing.

7. The lamp unit according to claim 1, wherein the first region is disposed in an upper half portion of the projection lens and extends into the lower half portion of the projection lens with respect to the front view of the lamp unit.

8. The lamp unit according to claim 1, further comprising a reflector comprising a reflection surface having s shape based on an elliptic sphere whose major axis coincides with the optical axis, wherein the upper edge of the shade is arranged at a focal point of the reflector.

9. The lamp unit according to claim 1, wherein said minute irregularities comprise dimples.

* * * * *